United States Patent [19]

Espejo

[11] 4,294,486

[45] Oct. 13, 1981

[54] CAMPER AND TENT UNIT

[76] Inventor: Eusebio H. Espejo, 1429 Alma St., San Pedro, Calif. 90731

[21] Appl. No.: 971,871

[22] Filed: Dec. 21, 1978

[51] Int. Cl.[3] ..... B60P 3/34

[52] U.S. Cl. ..... 296/167; 135/5 A

[58] Field of Search ..... 296/26, 156, 164, 165, 296/166, 167; 135/4 A, 4 B, 5 A, 5 AT

[56] References Cited

U.S. PATENT DOCUMENTS

| | | | |
|---|---|---|---|
| 3,010,462 | 11/1961 | Barber | 135/5 A X |
| 3,185,518 | 5/1965 | Zentner | 296/167 X |
| 3,326,594 | 6/1967 | Van Atta | 296/164 |
| 3,337,259 | 8/1967 | Henson | 296/167 |
| 3,438,670 | 4/1969 | Salmans | 296/164 |
| 3,596,977 | 8/1971 | Bunger | 135/5 A X |
| 3,598,441 | 8/1971 | Damiani | 296/164 |
| 3,937,516 | 2/1976 | Chapman | 296/26 |

FOREIGN PATENT DOCUMENTS

| | | | |
|---|---|---|---|
| 2604717 | 11/1977 | Fed. Rep. of Germany | 296/167 |

*Primary Examiner*—Joseph F. Peters, Jr.
*Assistant Examiner*—Norman L. Stack, Jr.
*Attorney, Agent, or Firm*—Subkow and Kriegel

[57] ABSTRACT

A camper and tent unit is applied to a passenger car and has a housing with a vertical section supported on the rear bumper of the car and a horizontal section extending forwardly and supported on the roof of the car. The vertical section contains a galley and the standard vehicle safety lights to be plugged into a connector on the car. A window in the vertical section affords clear rear vision. Bumper structure engages the car bumper for protection. The horizontal section houses folded tent components and poles enabling erection of a complete camper-tent including the housing and flooring.

21 Claims, 29 Drawing Figures

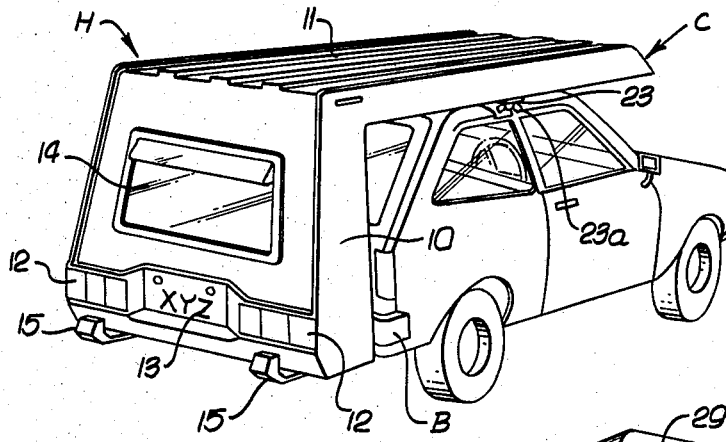
FIG. 1.
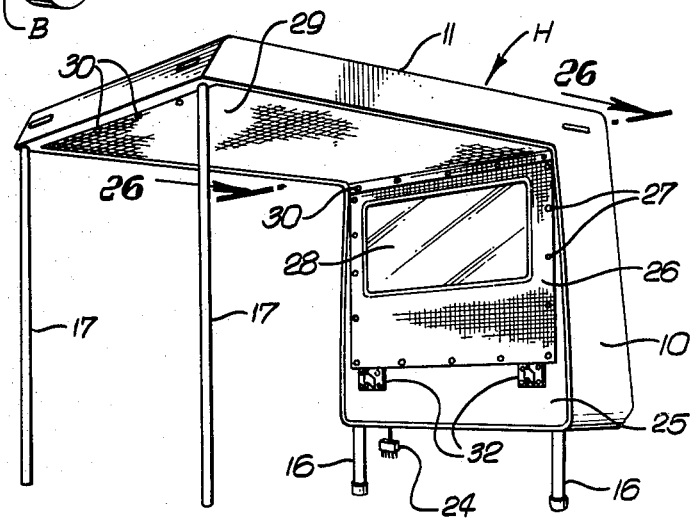
FIG. 2.
FIG. 3.
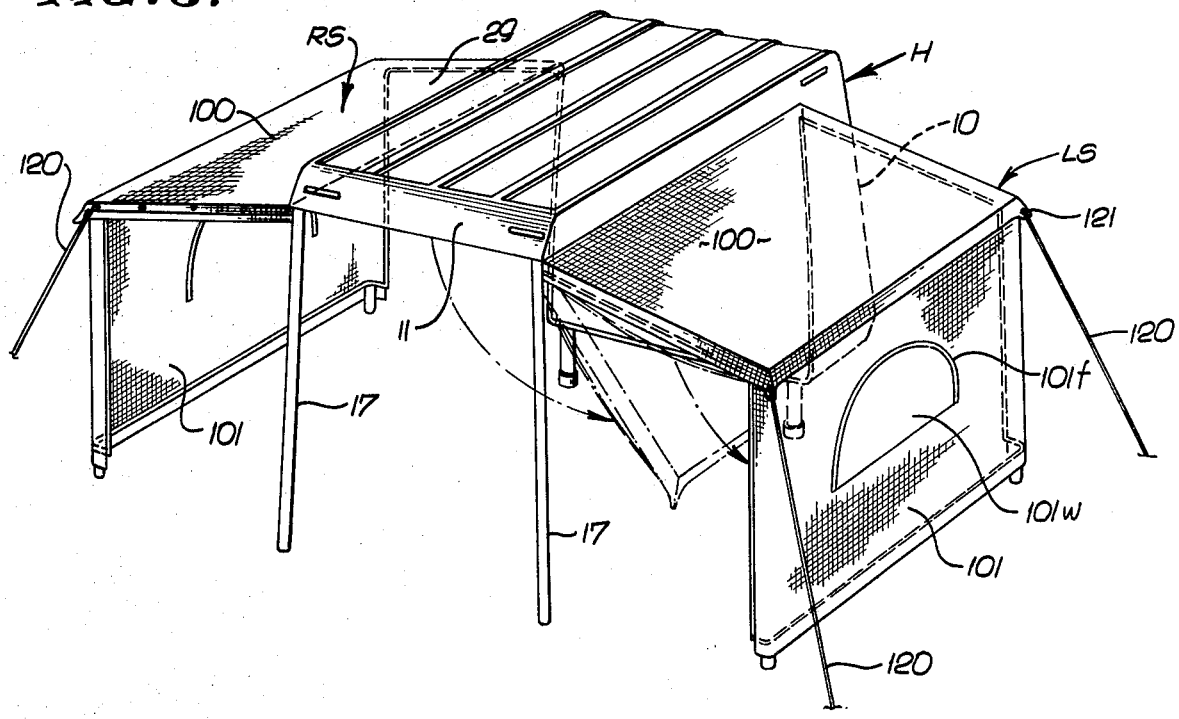

CAMPER AND TENT UNIT

Camping is enjoyed by many persons utilizing self-contained camper vehicles, truck mounted campers and tents. Camper vehicles and truck mounted campers are quite expensive. Tents are significantly less expensive, but must be separately transported and are often difficult to erect, and any convenience devices, such as water supply, work surface, cooking or storage must be separately provided and transported.

Many small cars do not have storage space which can accommodate a tent and other gear, together with, say, four persons without resorting to roof mounted racks of various types which cause instability and top heaviness of the car.

The present invention involves a camper and tent unit applicable to passenger cars, including various small passenger cars, which is compact and easy to install and use.

The unit has a housing which receives and stores a tent in such a manner that the tent can be folded from beneath the housing and set up to form with the housing a complete enclosure.

More particularly, the present invention provides a camper and tent unit, including a shell or housing having a vertical section adapted to be supported upon the rear bumper of a passenger car and a horizontally extended upper section, adapted to extend above the roof of the car, the vertical section containing various convenience devices, such as, for example, a cooking facility, a sink, work and storage space, constituting a small galley, and the horizontally extended upper section constituting storage space for tent components, including laterally extensible roof sections and side, front and rear walls which are interconnectable and supported by suitable poles to provide a relatively sizable tent, extending laterally from the housing structure, and including a floor or ground sheet section.

The housing shell construction includes safety features, such as the required directional, tail and stop lights, incorporated in the housing structure and adapted for connection with the electrical system of the car, by a simple plug connection, as well as a rear view window, whereby unobstructed vision rearwardly of the car is permitted. The housing structure also includes bumper structure, which extends between the rearward portion of the housing and the car bumper, and is connected thereto in such a manner as to protect the housing structure from the effects of rear end collision.

The housing structure, containing the tent components, is adapted to be simply mounted upon the passanger car, by hitch devices which are the subject of my companion application filed contemporaneously herewith, Ser. No. 972,041. The forwardly extending or upper horizontal section of the housing is adapted to be supported on the roof of the passenger car by connection to the rain gutter at each of the sides of the car, in the manner of a typical roof-mounted luggage rack, with the result that the overall weight of the camper and tent unit is distributed along the length of the passenger car in such a manner that the weight is well distributed to the four wheels of the car, and, as a consequence, the passenger compartment of the car can be employed for the transporting of campers, without requiring the storage of camping gear within the car itself.

The tent components are constructed to be interconnected with one another, so that, in combination with suitable frame and pole structures, which are stored within the horizontal section during transport, a rigid and durable, attractive tent structure is provided, the tent structure being capable of simple erection, after the housing structure has been supported on legs or posts and the passenger car disconnected from the housing structure and driven from beneath the housing structure.

In accomplishing the foregoing, the housing structure comprises a vertical section containing the galley and storage components, referred to above, and extending horizontally therefrom is a hollow shell section in which are stored a pair of laterally extensible roof components, having side walls, and other tent components comprising a front wall, flooring and rear walls adapted to be disposed at opposite sides of the vertically extended housing section to complete the tent structure, including the necessary supporting frame structures, all of which are housed within the upper shell section of the housing. During transit the tent components are housed within the shell and protected by a removable flap or cover, and, correspondingly, the galley is closed by a removable cover which contains a rear view transparent section, so as to not inhibit adequate rear vision.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings:

FIG. 1 is a perspective view illustrating the camper and tent unit of the invention applied to a typical passenger car;

FIG. 2 is a perspective view illustrating the camper and tent unit in an initial condition, supported upon posts, following removal of the passenger car from the unit;

FIG. 3 is a perspective view illustrating the initial stages of erection of the tent structure, as viewed, predominantly, frontally;

Figure 4:
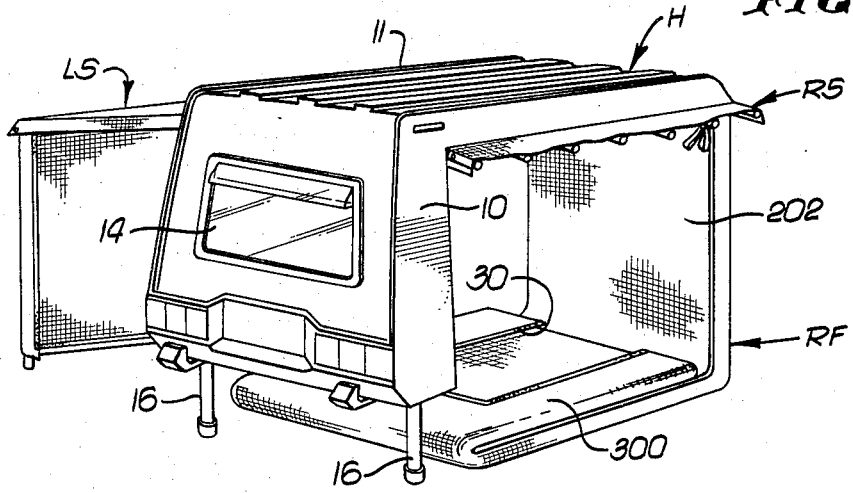
FIG. 4 is a perspective, as viewed predominantly from the rear, with one roof end side wall section broken away, to illustrate a second stage in the erection of the tent structure.

As seen in the drawings, a camper and tent unit C is applied to a passenger car T, and includes a housing structure H which is comprised of a vertical housing section 10 mounted, as will be later described, on the rear bumper B of the passenger car, and a horizontally extended housing section 11 mounted, as will be later described, on the roof of the passenger car. As can be seen from FIG. 1, the mass of the camper unit C, being supported on the rear bumper and extending forwardly over the vehicle and being supported on the roof of the vehicle, is distributed longitudinally of the vehicle so as to not render the vehicle top heavy or unwieldy. Accordingly, the passenger car, even though being of the modern-day compact or small car type can be employed to transport a number of passengers, without requiring the interior of the passenger car to transport camper facilities, as will be later described.

As also seen in FIG. 1, the vertical housing section 10 covers the entire rear area of the passenger car, and therefore, the housing section 10 is provided with the usual vehicle lights at the left and right hand sides thereof, designated 12, and including the usual tail lights, brake lights and turn signals. In addition, the housing section 10, centrally thereof, has a recessed section 13 adapted to receive the usual license plate 13, which is removed from the rear of the car and applied to the camper unit in a suitable, simple manner. Since the camper unit is carried by the passanger car, no separate license plate is required. Since the rear view window of the passanger car is covered by the housing section 10, the housing is provided with a rear view window 14 which is proportioned and shaped to afford a wide range of rear vision, so that the driver of the car can utilize the usual rear view mirror within the car in the same manner as though the camper were not in place. Bumper structure 15 is also provided at the lower end of the housing section 10 and is, as will be later described, in thrust relation with the car bumper B.

Figure 21:
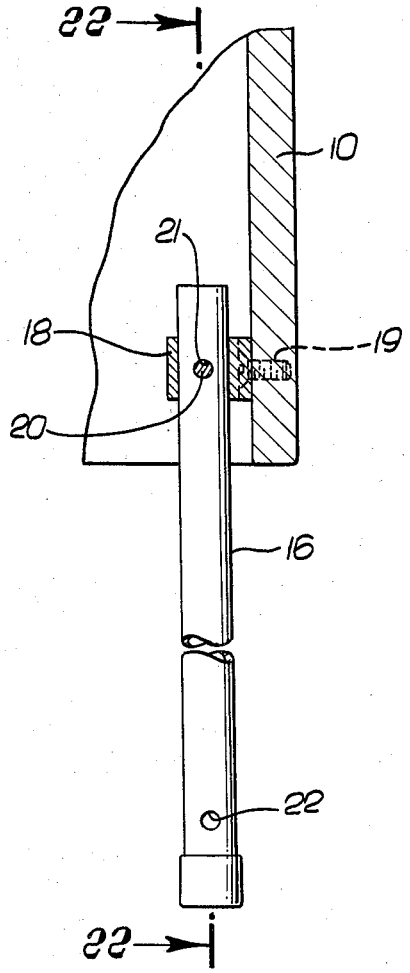
FIG. 21 is an enlarged fragmentary view in vertical section, illustrating the rear post structure for the housing, in a housing supporting position.
Figure 22:
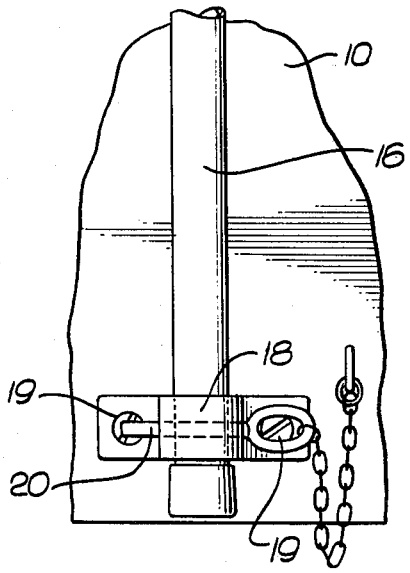
FIG. 22 is a view, as taken along the line 22—22 of FIG. 21, but showing the leg retracted.

Referring to FIG. 2, the camper unit is shown in an initial condition following removal of the car from beneath the housing. The camper unit is supported on a pair of rear posts or legs 16, which will be later described in greater detail, and at the forward end of the horizontal section 11, the unit is supported on a pair of corner poles 17, which will also be described in greater detail hereinafter. The rear legs or posts 16 are normally received within the housing structure as seen in FIGS. 21 and 22. More particularly, an eye 18 is suitably secured internally of the housing section 10, as by fasteners 19. The eye has a pair of diametrically spaced holes adapted to receive a pin 20 which can extend through longitudinally spaced holes 21 and 22 in the respective post or leg 16, whereby the post can be retracted as shown in FIG. 22, during transport, and can be lowered and locked in position to support the rear end of the housing, as shown in FIG. 21. Before removal of the car from the camper unit, the legs or posts 16 are extended downwardly and locked in place, as seen in FIG. 2, and then the forwardly extending housing section 11 can be released at fasteners 23*a* from the usual roof luggage rack type structure 23, which is secured to the usual rain gutters of the car, and the forward poles 17 can be installed beneath the forward extremity of the housing, in a manner causing the forward end of the housing to be somewhat elevated from the roof of the car. The bumper hitch connection, as seen in detail in FIGS. 28 and 29, and which will be later described, can then be released, enabling the car to be driven forwardly between the forward support poles 17. As also seen in FIG. 2, the electric plug connector 24, carried by the camper unit and, during transport, plugged into an appropriate connector provided on the car, is disconnected. The inner wall 25 of the vertical housing section 10 has a rectangular protective fabric cover 26 secured thereto as by suitable snap or other fasteners 27, the cover 26 having a rectangular plastic window 28 substantially conforming to the size and shape of the rear view window 14 in the housing section 10, whereby during transport, rear vision is not impaired by the cover 26. Another rectangular cover 29 is secured, as by suitable snap or other fastener 30, to the underside of the housing shell section 11. These protective covers protect the galley and the tent components, to be hereinafter described.

Figure 28:
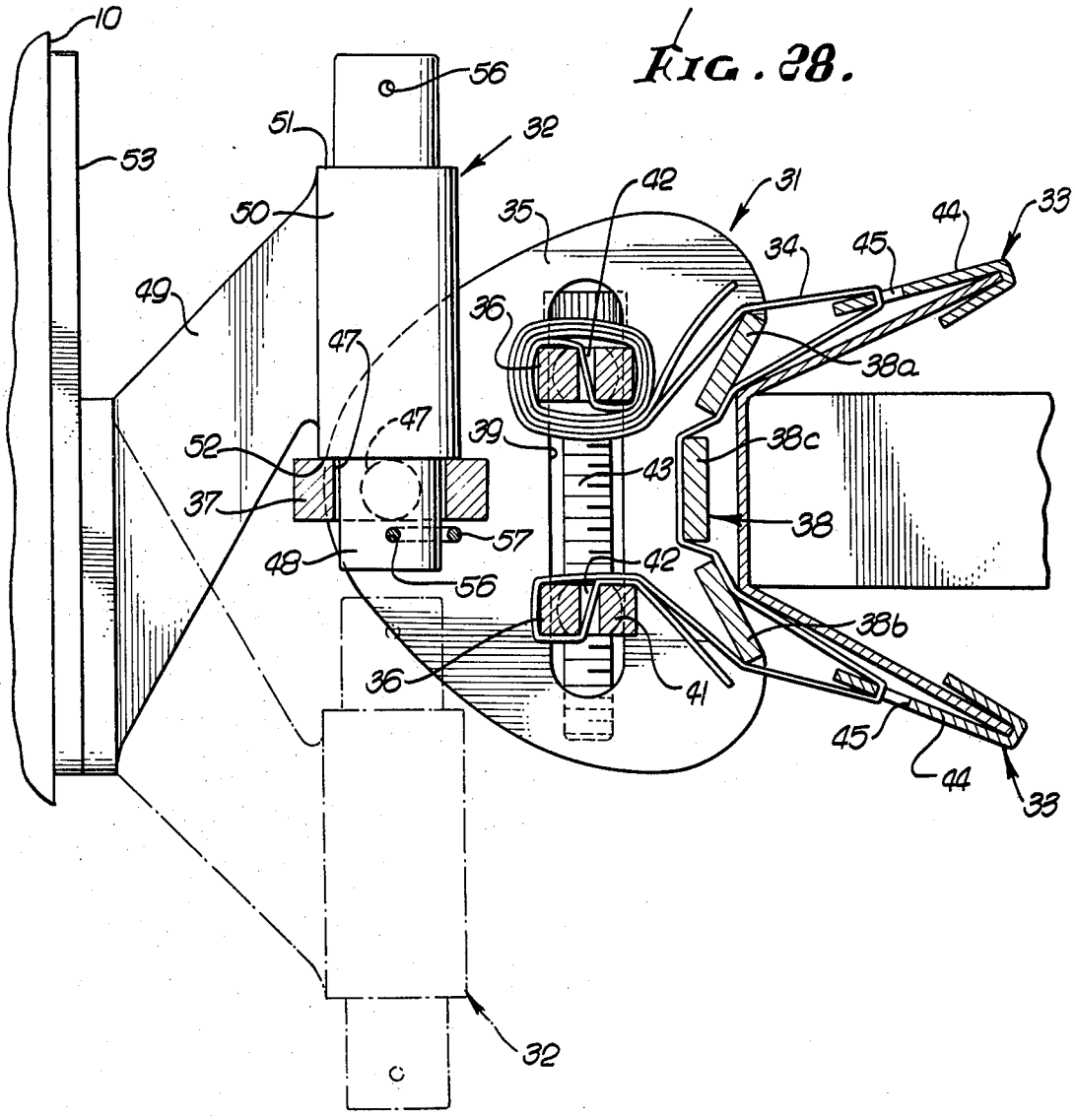
FIG. 28 is an enlarged fragmentary view, partly in vertical section and partly in elevation, showing a typical bumper connector useful in supporting the housing structure on the rear bumper of the car.
Figure 29:
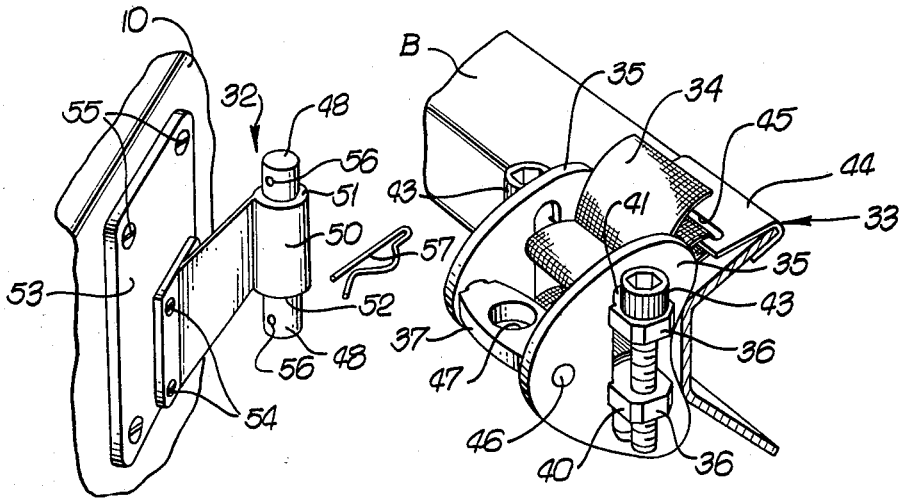
FIG. 29 is an exploded detail view in perspective illustrating the bumper hitch of FIG. 28.

The bumper hitch or mount for the rear or vertical section 10 of the housing structure is seen in FIGS. 28 and 29. The bumper hitch is applied to the bumper B of the motor vehicle, and includes a clamp section 31 and a companion connector support section 32, adapted to be brought together and interconnected to support the housing section 10. The clamp section is secured to the bumper B by a pair of hooks or clips 33 adapted for engagement over the inner edge of the upper and lower flanges of the bumper, the hooks being connected to the clamp by a web or strap 34 of the usual and well known type utilized in hoisting and tying down materials during transport, which is readily available and which is durable, abrasion resistant and of substantial tensile strength, on the order of a number of thousands of pounds in a single strand.

The clamping structure 31 includes a pair of opposed sidewalls 35 between which extend a plurality of cross members, including a pair of strap tensioning cross members 36, a cross member 37 adapted for connection with support member 32, and forward cross members 38, through which an intermediate section of the strap is extended for connection with the hooks or clips 33, with the ends of the strap engaged with the cross members 36, in a manner to be hereinafter described, whereby the strap can be initially tightened to position the clamp structure on the bumper, and thereafter forcefully tensioned.

This hitch is ideally suited for use with the present invention, but also has other uses and is specifically the subject of application, Ser. No. 972,042, filed concurrently herewith.

In the form illustrated, each of the side walls 35 has a vertically elongated slot 39, through which the strap tensioning cross members 36 extend at opposite ends. Each cross member 36 has, at its opposite ends, enlarged heads 40 located exteriorly of the side wall and a circular shank section 41, which is disposed in the slot 39, enabling the cross member 36 to be rotated while the enlarged head sections retain the cross members in place. Within the side walls 35, the body of the strap tensioning cross members 36 is provided with an elongated slot 42 adapted to have an end of the strap threaded therethrough, whereby rotation of the cross members 36 through one half or more turns will wind an end of the strap upon the cross member 36, upon the end extremity of the strap which is frictionally engaged between the intermediate section of the strap and the cross members and in response to tension firmly locked thereto. As seen in FIG. 28, the lower cross member 36 has been rotated sufficiently to cause the end extremity of the strap to be frictionally engaged beneath a single strand of the intermediate section of the strap and the cross member 36 in such a manner that the greater the tension on the strap, the greater will be the frictional locking effect of the strap on the cross member. The upper cross member 36 has been turned a number of revolutions to eliminate initial slack from the strap.

The enlarged heads 40 of the cross members 36, externally of the side walls 35, are structured to accommodate tightening bolts or cap screws 43 which are rotatable in the upper cross member and threadedly engaged in the lower cross member, at the opposite ends thereof, whereby the bolts can be rotated by an appropriate socket wrench, or the like, and the cross members will be forceably moved one towards the other to tension the strap 34, as will be later described.

The cross members 38 provide a rigid interconnection between the two side walls 35 and are suitably interconnected therewith, as by welding. These cross members include an upper cross member **38*a*, a lower cross member 38*b*, and an intermediate cross member 38*c*. The cross members 38*a* and 38*b* provide outwardly facing divergent surfaces adapted to oppose the outer upper and lower corners of the vehicle bumper, or bumpers of a range of sizes and forms, while the intermediate cross member 38*c*, when the strap 34** is installed as illustrated, provides the primary anchor point for the clamp body structure.

The hooks or clips 33 are preferably, as shown, constructed of thin metal material, which facilitates application of the hooks to the upper and lower inner edges of the bumper. Each hook has a flat body section 44 provided with a transverse slot 45 through which the web or strap slidably extends. At the outer end of the hook body it is recurved or bent back upon itself to provide a bight engageable with the edge of the bumper.

The connector cross member 37, previously referred to, is mounted between the side walls 35 of the clamp body structure. In the specific form illustrated, the cross member 37 is in the form of a plate having cylindrical end sections 46 disposed in circular holes formed in the side plates 35. These pivot supports enable the support plate 37 to rock on a horizontal axis. The connector plate 37 has a central circular opening 47 adapted to receive a pin 48 of the connector section 32, as will be later described, whereby the connector section 32 can pivot on a vertical axis relative to the horizontally pivoted connector plate 37, thereby providing, essentially, a universal connection.

The connector section 32 herein illustrated, includes the previously described pin 48 which is carried by an arm 49 having at its outer extremity a sleeve 50 which receives the pin 48 in a manner whereby the pin projects at its opposite ends below and above the upper and lower shouldering surfaces 51 and 52 of the sleeve, which as seen in FIG. 28, rest upon the surface of the connector plate 37, when the hitch is assembled.

The arm 49 is disposed at an angle or incline relative to a horizontal plane, and is appropriately mounted upon a face plate 53 as by suitable fastenings 54, the face plate, in turn, being connectable, as by fasteners 55, to the housing section 10. The upper and lower ends of connector pin 48 are provided with drilled holes 56 adapted to receive a cotter pin or resilient pin 57, whereby, upon assembly with the clamp, the connector structure is locked in place.

As shown in broken lines in FIG. 28, the connector structure 32 is adapted to be inverted from the full line position, whereby the angle of the arm and the double pin will enable the supported structure to be more or less elevated with relation to the height of the bumper to which the clamp is applied.

To apply the clamping structure to a bumper, a suitable length of the intermediate section of the strap is pulled from the cross members 36, to allow the hooks 33 to be applied to the edges of the bumper. During this operation, the bolts or cap screws 43 are removed. One or both of the cross members 36 can be manually rotated to take up the slack from the strap, and thereafter the bolts or cap screws can be inserted through the upper cross member 36 and threadedly engaged in the lower cross member, and then the bolts can be turned by an appropriate tool or socket wrench. Tightening of the bolts 43 moves the cross members 36 one towards the other so as to tension the strap 34 and draw the body structure of the clamp tightly into engagement with the bumper, but with the straps forming a protective layer between the metal portions of the clamp and the bumper.

Figure 26:
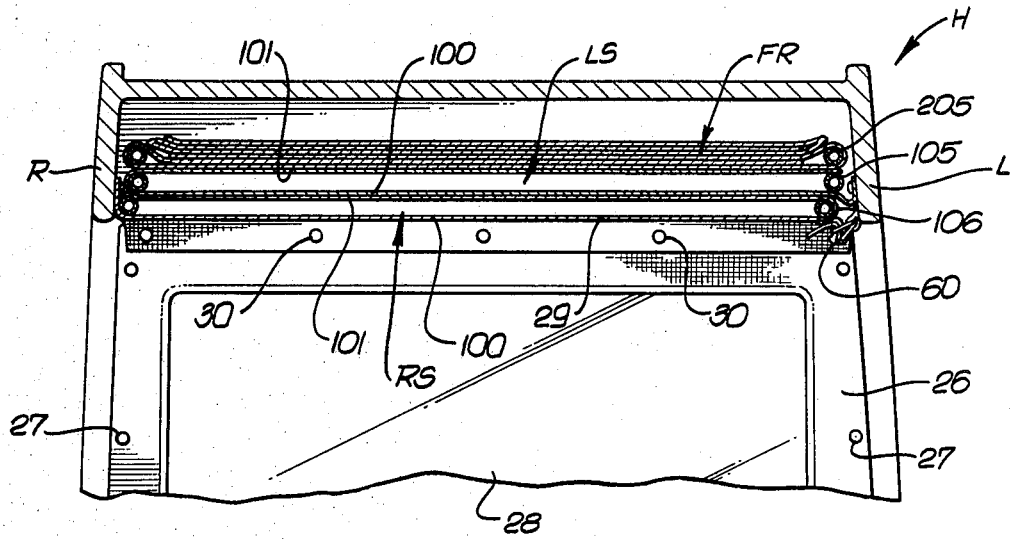
FIG. 26 is a transverse section, as taken on the line 26—26 of FIG. 2, illustrating the stored tent components within the horizontal shell of the housing structure.

Referring to FIGS. 2 through 6, and to FIG. 26, the tent components, which are stored within the housing during transport, will be seen to comprise three tent sub-units comprising, as viewed from the rear, a right side sub-unit RS, a left side sub-unit LS and a front and rear sub-unit FR, which also includes a floor F, which are housed between the opposed side walls L and R of the horizontally extended housing section 11, at the left and right hand sides thereof, again as viewed from the rear. Such storage of the tent sub-units in the housing section 11 is best seen in FIG. 26. Each side unit RS and LS includes a roof panel 100 and a side panel 101, and in the specific form of the invention shown, the roof panel 100 of the right side sub-unit also provides the protective cover 29 which underlies the horizontally extended housing section 11, during transport.

Figure 5:
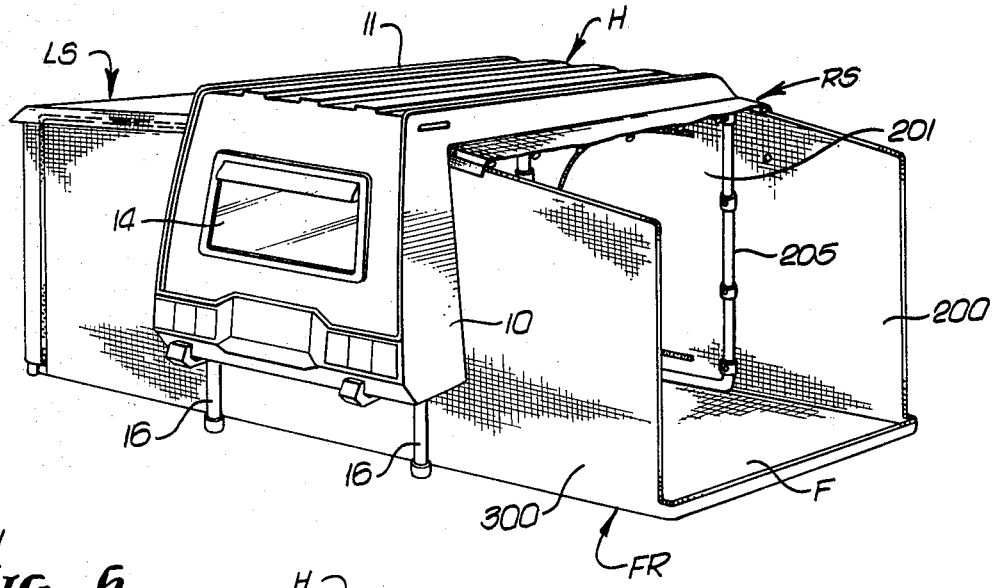
FIG. 5 is a view corresponding to FIG. 4, but showing the tent floor and the erected rear tent walls which straddle the housing.
Figure 6:
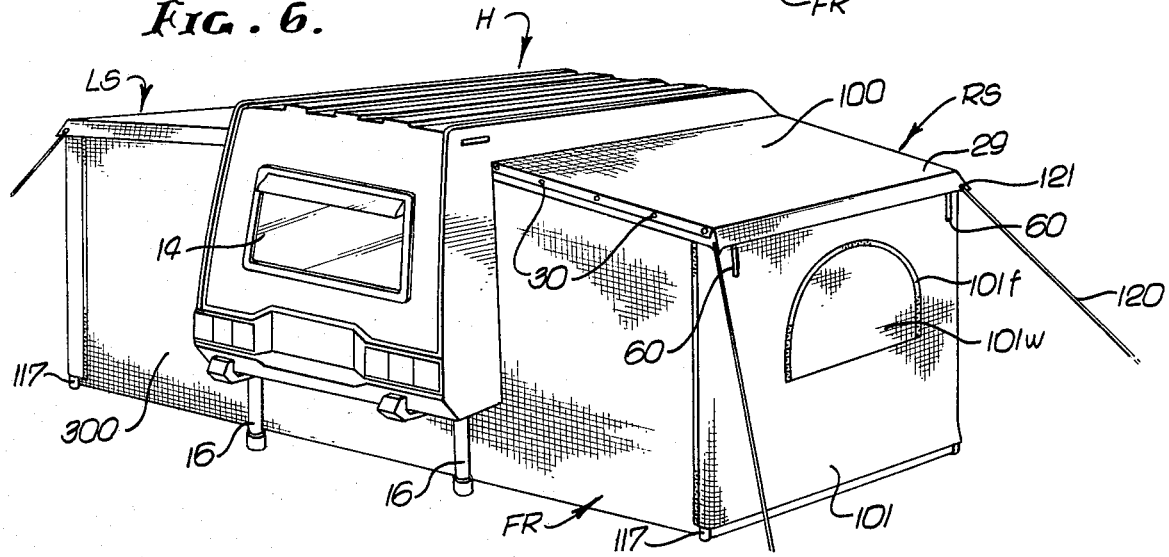
FIG. 6 is a view corresponding to FIGS. 4 and 5, but showing the fully erected camper and tent unit.
Figure 7:
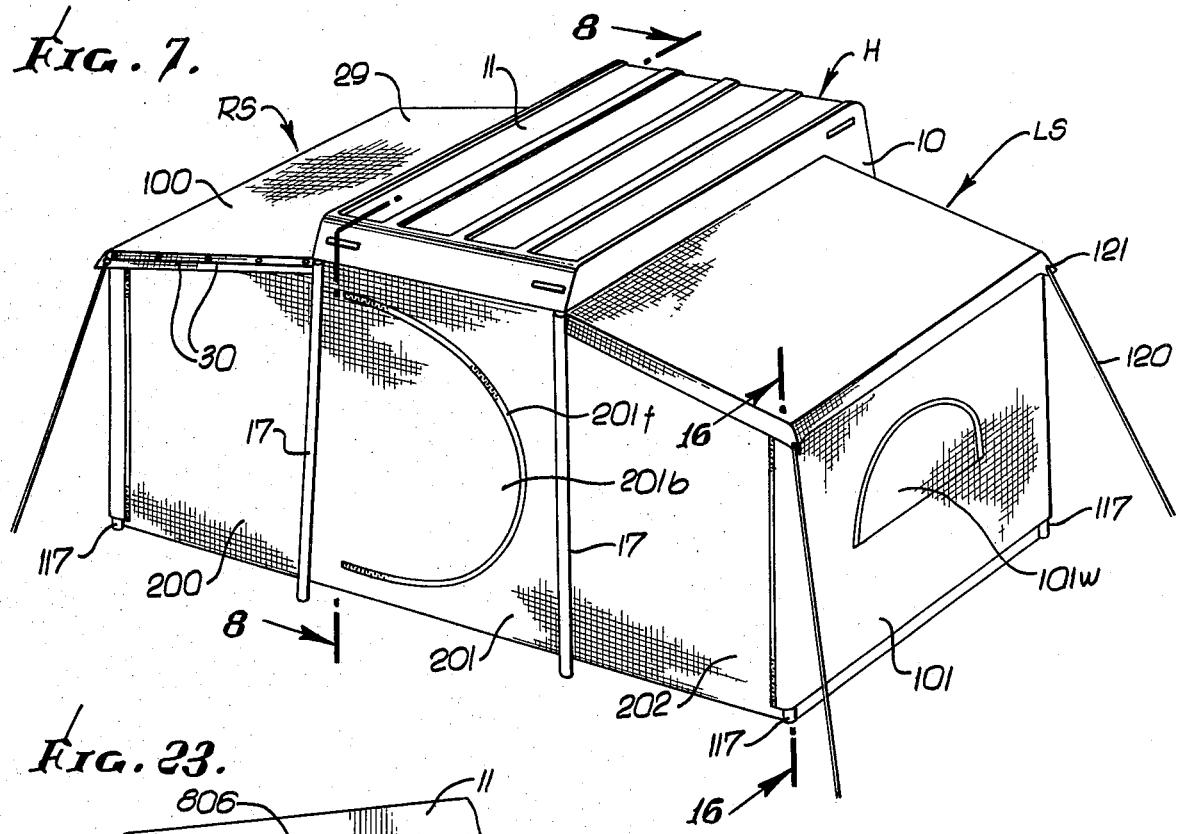
FIG. 7 is a view in perspective, as viewed predominantly frontally, showing the fully erected camper and tent unit.
Figure 23:
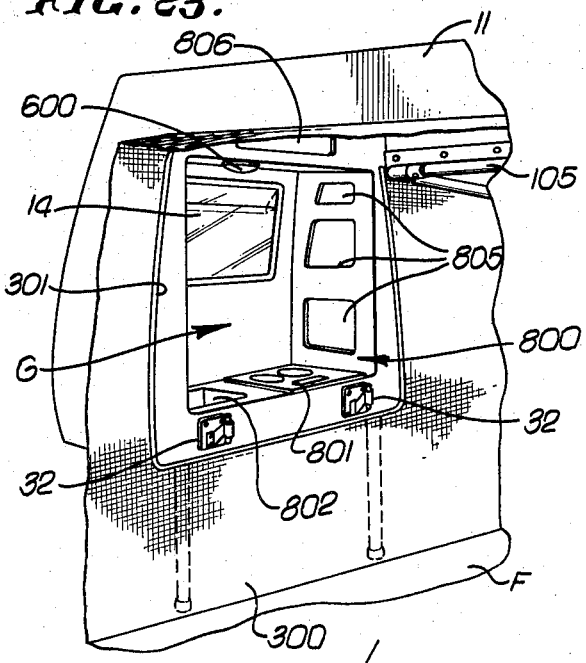
FIG. 23 is a fragmentary view in perspective, illustrating the interior of the erected camper and tent unit, looking in the direction of the galley.

After the right and left side sub-units are swung outwardly from beneath the housing section 11 and laterally thereof, they can be erected, in a manner to be described hereinafter, as shown in FIGS. 3 and 4 to provide the side walls and roof of the tent structure. Thereafter, the roof and floor sub-unit RF can be swung downwardly, as seen in FIG. 4, wherein several panels of the sub-unit are in a folded condition. These panels include a right front panel 200, a front center panel 201, and a left front panel 202. The panels also include a rear panel 300 which is adapted, as seen in FIG. 5, as well as in FIG. 6, to extend laterally at opposite sides of the housing structure, as well as beneath the housing structure, the panel 300 being cut away at 301 to expose the galley, as seen in FIG. 23 and in FIG. 24. The rear panel 300 is erected and connected to the housing structure and to the roof panels, in a manner to be later described, with the flooring F, extending between the rear tent walls, and between the side walls of the tent structure.

Referring to FIGS. 8 through 14 and 26, it will be seen that the roof sections of the tent sub-units RS, LS and RF are preferably provided with interior frame assemblies which assist in the support of the assembled tent structure, but which are foldable into the housing structure along with the tent panels. In addition, a frame structure is preferably provided within the front center panel 201. These frames will be later described. Referring to FIG. 26, wherein the panels and the frame structures are shown in the stored condition, it will be seen that the protective panel 29, which also constitutes the right side roof panel 100, is secured by the previously described snap fasteners 30 on the side of the housing, and the remaining panel structure is all housed within the housing. Suitable ties or buckle devices 60 are also employed at suitable locations along the lower edge of the right housing wall R to assist in retaining the panels within the housing during transport.

Figure 10:
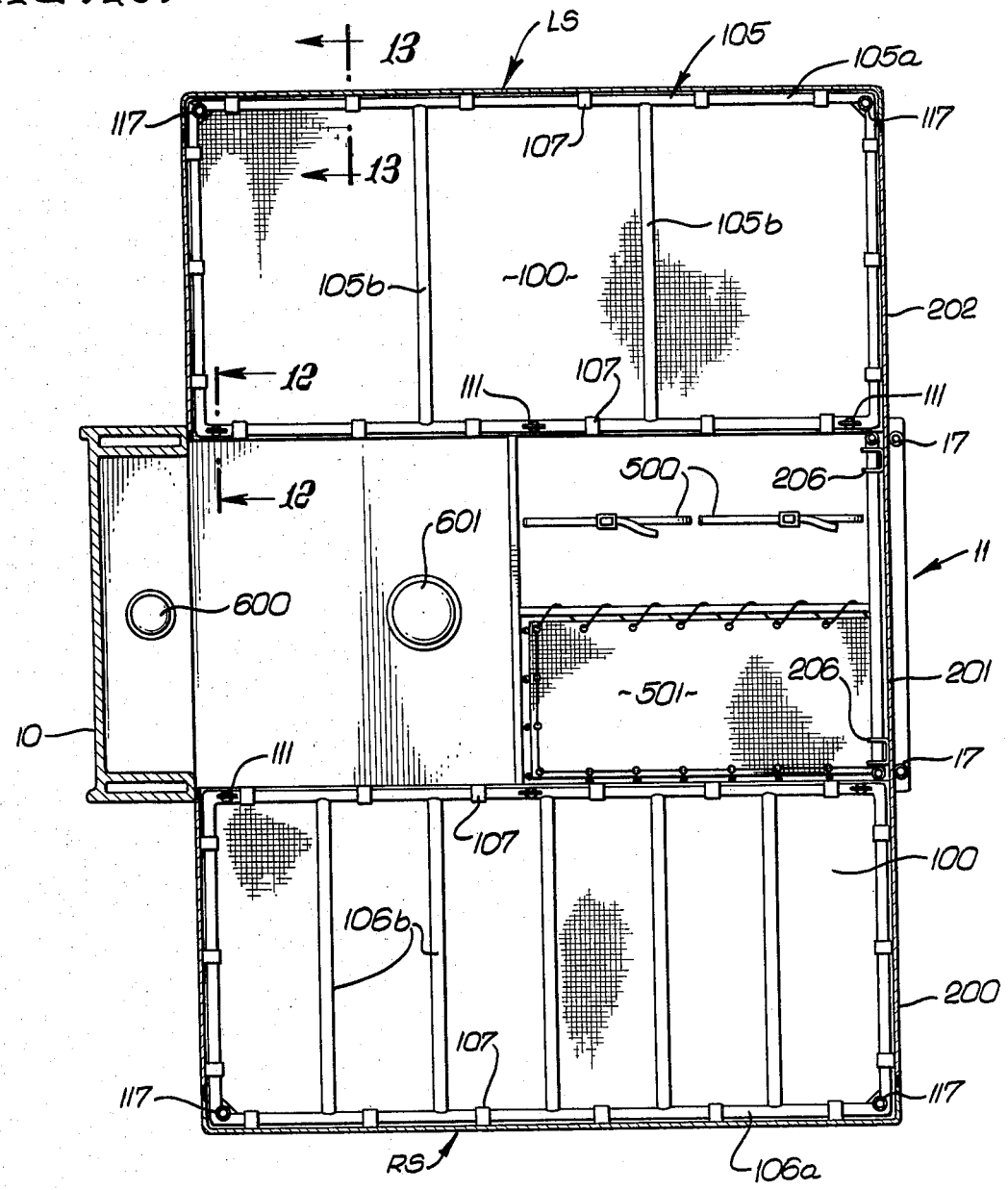
FIG. 10 is a horizontal section, as taken on the line 10—10 of FIG. 8.

The roof supporting frame structure for the left side panel is designated 105, while the roof frame structure for the right side roof panel is designated 106, and the central front frame support is designated 205, as easily seen in FIG. 10, for example. The left side frame 105 is generally of rectangular shape and includes an outer peripheral frame **105*a* and suitable cross support members 105*b*, the frame structure being composed of suitable rigid tubular material, such as aluminum tubing, which is sufficiently strong but yet light weight. Correspondingly, the right side frame structure 106 has a rectangular outer frame 106*a* and a number of cross frame members 106*b*. In the preferred form, a larger number of more closely spaced cross frame members 106*b* are employed in the frame 106 than the cross members 105*b* in the frame 105, since the frame 106, in the stored condition, constitutes the lowermost frame structure, upon which the weight of the other frame structures and panels are supported, as seen in FIG. 26**.

Figure 13:
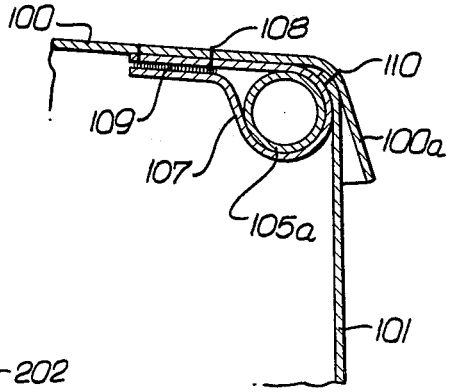
FIG. 13 is an enlarged, fragmentary, detailed view, in section, illustrating the connection of the frame structure beneath one of the side roof panels, as taken along the line 13—13 of FIG. 10.

The frame structures 105 and 106 are secured to the undersides of the roof panels 100 by a plurality of fabric loops, 107 spaced at appropriate locations about the frame structure. A typical loop 107 is seen in FIG. 13, at the juncture between a roof panel 100 and a side wall 101, wherein it can be seen that the loop 107 is suitably affixed as by stitching 108, at at least one end of the loop, and the loop extends about the frame rail **105*a* so that the ends of the loop 107 can be joined together by suitable means, such as a "Velcro" connector 109 or other suitable fastener. In FIG. 13, it can also be seen that the side wall 101 and the roof panel 100 are also joined together, as by stitching 110, and that the roof panel has a downwardly and outwardly depending skirt or eave 100*a*** which extends along the length of the side panel.

Figure 12:
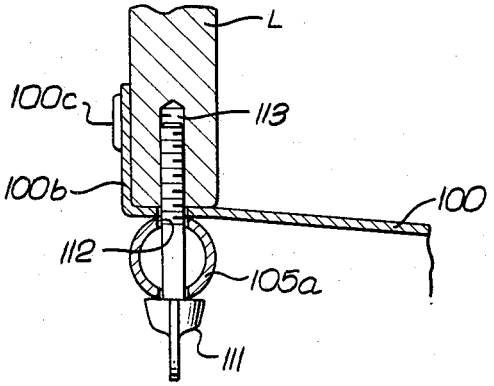
FIG. 12 is an enlarged, fragmentary, vertical section as taken on the line 12—12 of FIG. 10, showing the attachment of a side tent panel and frame structure to the shell.

As seen in FIG. 12, as well as in FIG. 10, the inner sides of the respective roof frame structures are also adapted to be securely affixed to the lower edge of the side walls of the shell. The roof panel 100 has its inner edge **100*b* extending upwardly within the interior of the side wall L and secured thereto as by a suitable number of snap fasteners 100*c*, at locations spaced along the length of the roof panel. The roof panel and the frame pivot outwardly from within the shell to the outwardly projecting condition, as shown by the broken lines in FIG. 3, and, thereafter, thumb screws 111 can be installed through holes 112 in the frame 105, and threaded into threaded bores 113 in the side wall L to fix the rail 105 to the side wall L. The illustration in FIG. 12 is typical of the manner of applying a suitable number of the thumb screws to the respective frame structures 105 and 106. As seen in FIG. 10**, there are three such thumb screws installed in each frame, to connect the same to the side wall of the shell.

Figure 17:
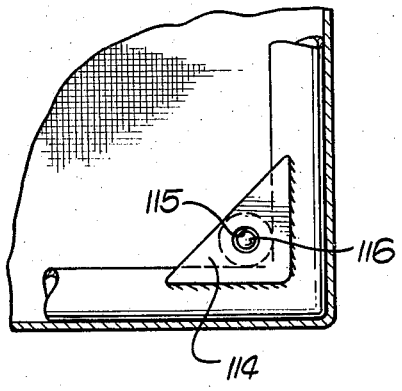
FIG. 17 is a horizontal section, as taken along the line 17—17 of FIG. 16.
Figure 18:
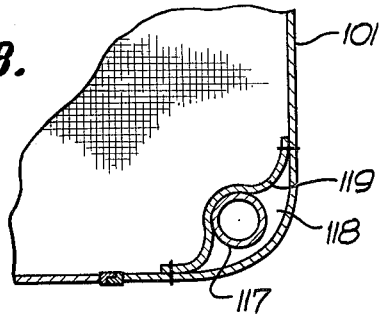
FIG. 18 is a fragmentary horizontal section as taken along the line 18—18 of FIG. 16.

Referring to FIGS. 10 and 15 through 18, it will be seen that at the opposite outer corners of the respective frames 105 and 106, a typical corner being seen in FIG. 17, a gusset 114 is suitably affixed as by welding in the corner of the frame structure, the gusset having a socket 115 therein which is adapted to receive a pin or projection 116 at the upper end of a corner support hole 117. These corner poles 117 are installed in vertically extended openings 118 provided at each of the outer corners of the side panels, as by stitching into the corners, as seen in FIG. 18, a vertically extended inset 119.

It will now be recognized that when the respective right side and left side panels are swung from the stored condition to the laterally extended condition, a pole 117 can be inserted through the respective openings 118 to engage in the corner gussets, to provide a vertical support beneath each corner, and thereafter, suitable tent ropes or guy lines, which are secured to the respective corners of the roof structure at 121, can be anchored to the ground to securely fasten the tent structure in place.

Figure 15:
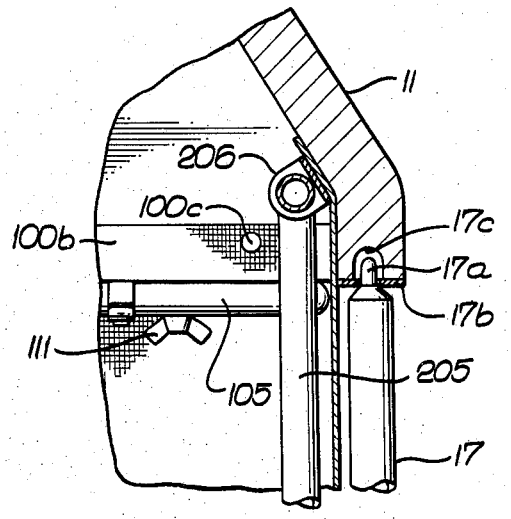
FIG. 15 is a fragmentary, enlarged, detailed view in vertical section, as taken along the line 15—15 of FIG. 9.
Figure 16:
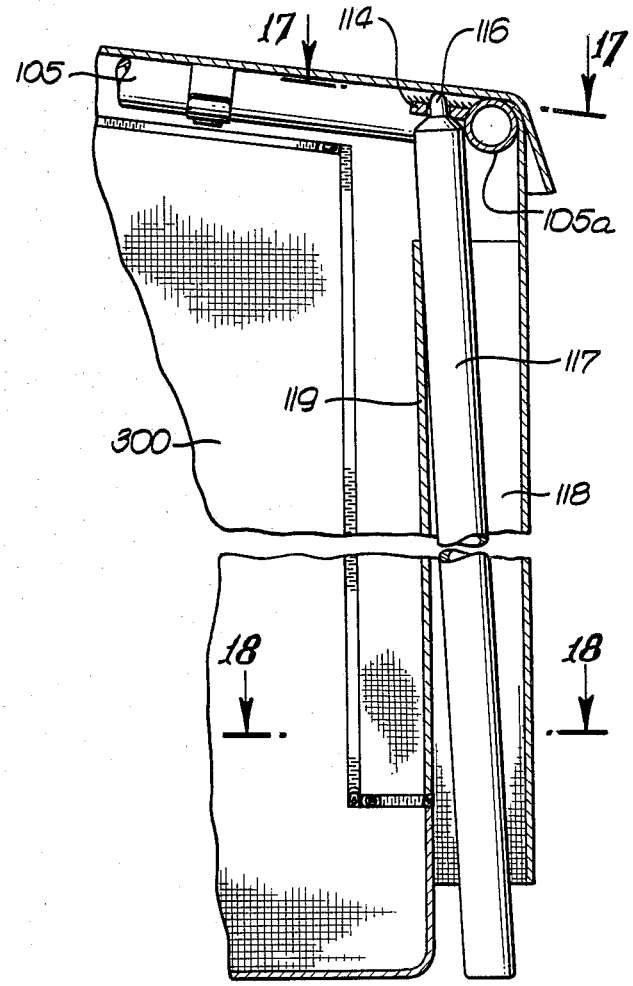
FIG. 16 is an enlarged fragmentary view in vertical section, as taken along the line 16—16 of FIG. 7, showing one of the corner posts for the tent structure.

As seen in FIG. 15, the support poles 17, which are installed beneath the forward end of the housing section 11, are constructed in the same manner as the corner poles 117. The housing support poles 17 have upper pins or projections 17*a* which extend through a reinforcing plate 17*b* into a cavity 17*c* formed at the forward lower edge of the housing section 11. It can also be seen in FIG. 15, as well as in FIG. 10, that the frame structure 205 is pivotally mounted in transversely spaced brackets 206 which are suitably mounted beneath the forward wall of the housing section 11, so as to pivot downwardly to the position shown in FIGS. 4 and 5 during erection of the tent structure.

Figure 11:
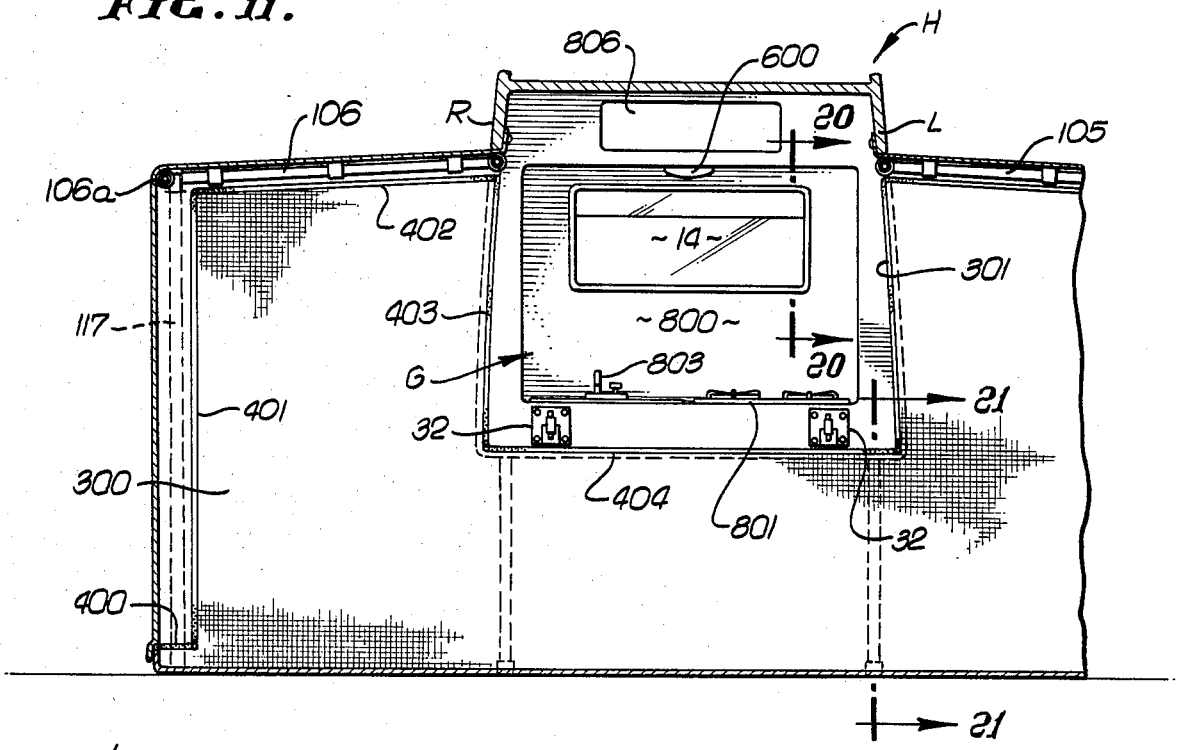
FIG. 11 is a transverse section, with one side broken away as taken on the line 11—11 of FIG. 8.
Figure 19:
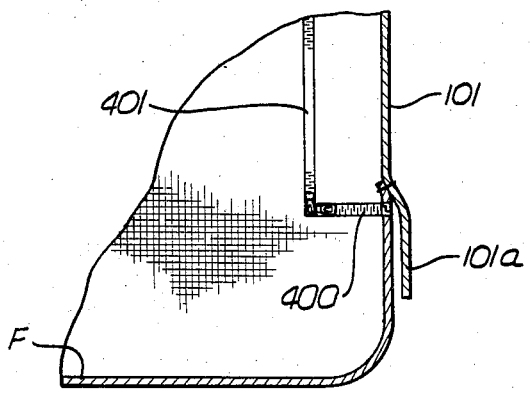
FIG. 19 is an enlarged fragmentary detailed view in section as taken along the lines 19—19 of FIG. 8, showing the juncture between the floor and a side wall of the tent structure.

As a final step in erection of the tent structure, the front and rear panels 200 and 300 are joined to the roof and side panels 100 and 101, and the floor panel F is joined to the side panels 101. Preferably slide fasteners are used for this purpose, but other fastening means may be employed. In addition, a slide fastener is preferably employed to secure the rear wall 300 along the vertical sides of the housing structure, as well as along the lower edge of the housing structure. As seen in FIG. 11, slide fastener means are provided at 400 along the juncture of the floor with the side wall, at 401 along the vertical juncture between the side walls and the rear wall, at 402 along the generally horizontal juncture of the rear wall and the roof panel, at 403 along the generally vertical juncture between the rear wall and the housing structure, and at 404 along the lower edge of the housing structure. A typical juncture between the floor F and a side wall 101 is illustrated in FIG. 19, wherein it can be seen that the side wall has a downwardly extended, exterior flap 101*a* which serves as a guard, and that the floor panel F is turned upwardly to a location within the flap 101*a*, whereby to prevent the intrusion of water.

Figure 9:
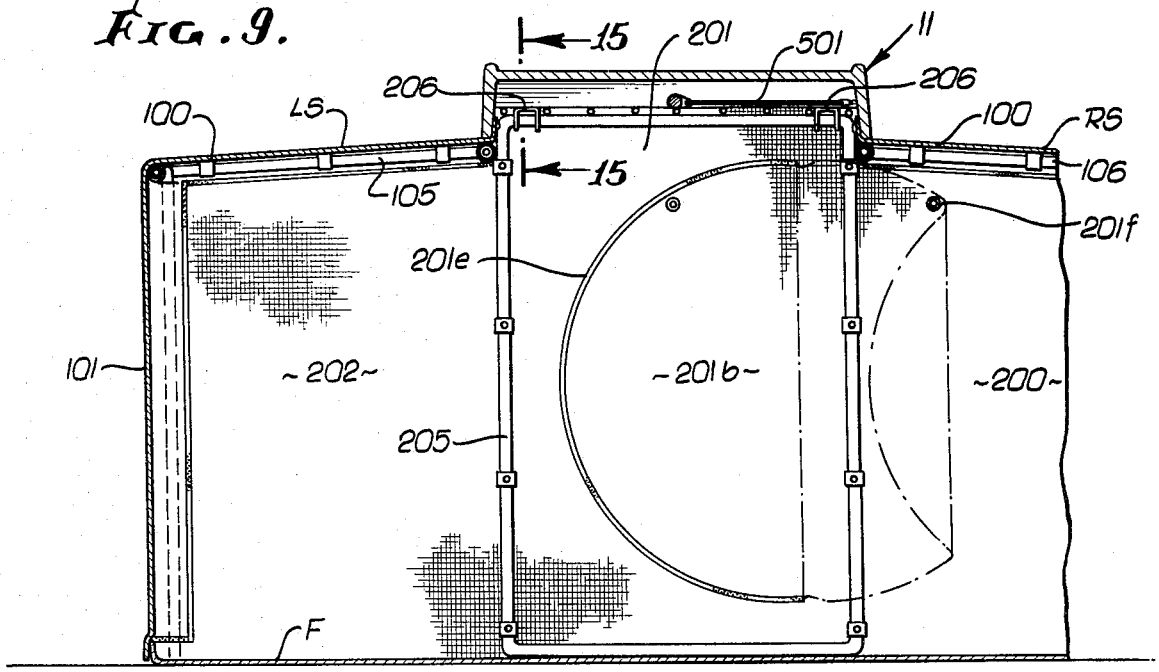
FIG. 9 is a transverse section, with one side broken away as taken on the line 9—9 of FIG. 8.
Figure 14:
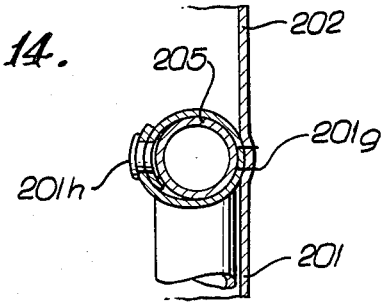
FIG. 14 is an enlarged, frangmentary, detailed view, in section, as taken along the line 14—14 of FIG. 8.

As seen in FIGS. 9 and 14, the front frame structure 205 is of rectangular form and provides a frame about a doorway 201*b* formed by a flap in the center panel 201 and closeable by a suitable slide fastener 201*e*, or foldable to the open position shown in broken lines in FIG. 9, to an out of the way location, at which it can be retained by suitable snap fastener 201*f*. The frame 205 is connected with the front tent panel as by means of the loops shown in FIG. 14, which are stitched to the tent panel as at 201*g*, and embrace the vertical sides of the frame 205, being secured to the latter as by snap fasteners 201*h*.

The housing provides certain conveniences, including, for storage purposes, suitable straps 500 which can be installed beneath the ceiling of the horizontally extended housing section 11 and a sling type storage shelf 501, which can contain various bedding, clothing, or flat items that can be stored during transport with the tent panels contained within the housing. In addition, as seen in FIG. 10, lighting 600 and 601 can be provided, and supplied with a suitable source of electricity, either from stored source, or, if desired, by reconnection of the electrical connector 24 to the battery system of the motor vehicle.

Figure 27:
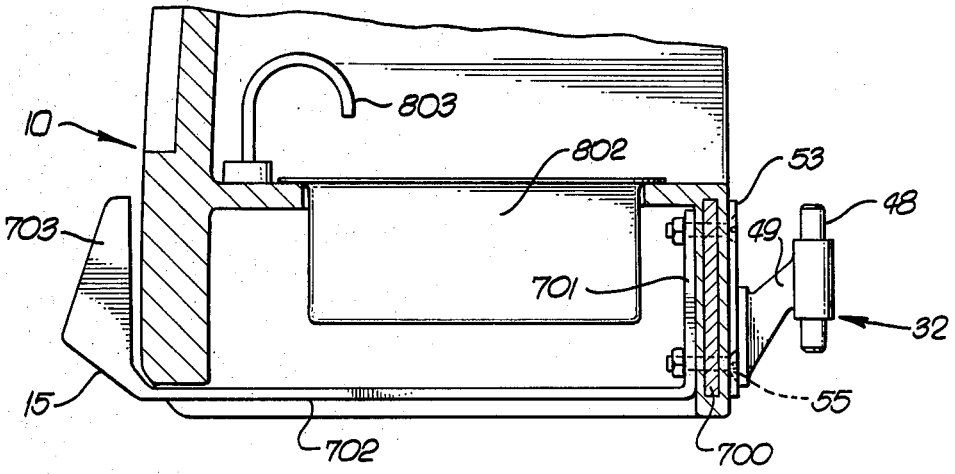
FIG. 27 is an enlarged, fragmentary detailed view showing the lower section of the vertical housing structure, as seen in FIG. 8, including the bumper structure connectible with the rear bumper of a car.

The protective bumper structure 15 is best seen in FIG. 27. In the form illustrated, the lower, inner side of the vertical housing section 10 has a transversely extended reinforcing plate 700, through which the fastenings 55 for the hitch plate 53 extend, to rigidly connect the hitch member to the reinforcing plate 700. In addition, the fastenings 55 connect a vertical end section 701 of bumper plates 702 which extend beneath the housing structure and have external bumper members 703 located, as seen in FIG. 1, at opposite sides of the lower section of the housing, adjacent to the safety lights. Thus, impact forces applied to the bumper members 703 will be transmitted through the bumper hitch structure, as previously described, to the bumper of the vehicle, thereby protecting the housing against damage.

Figure 20:
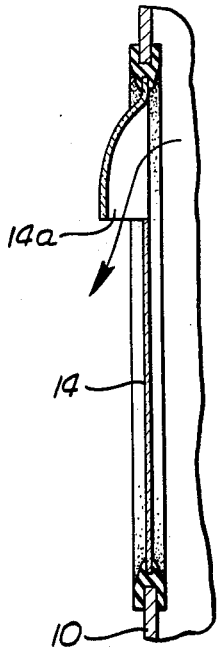
FIG. 20 is an enlarged fragmentary view in vertical section as taken along the line 20—20 of FIG. 11, illustrating the ventillating rear window of the housing structure.

Internally, the vertical housing section 10 has a galley G, seen in FIGS. 11, 23 through 25 and 27. For these purposes, the housing section is recessed to provide a work area 800, which in the illustrative embodiment, includes a usual camper stove 801, which may be supplied with gas, either from a portable source or from a tank appropriately mounted on or within the housing structure itself. Also provided in the work space 800 is a sink 802 provided with a suitable water outlet 803, to which water can be supplied from a storage tank carried within the vehicle, for example, as seen at 804 in FIG. 8. Suitable storage compartments 805 are also provided on one or both sides of the work area 800, as well as at 806 above the work area. As seen in FIG. 20, the rear view window 14 provided by the housing is a ventilated window, having an opening 14*a* for the flow of air outwardly from the work area, particularly heated air during the use of the cooking facility. Further, ventilation is provided for by the provision of flaps 101*w* in, for example, the side walls 101, which can be secured in a closed condition, as by suitable slide fasteners 101*f*. If desired, it will be understood that the door opening can also be provided with a removable screen insert, and that the windows preferably have screens which are flexible and facilitate the erection of the camper and tent unit.

From the foregoing, it will now be apparent that the present invention provides a simple and efficient combination of a housing or shell applicable to the rear bumper and the roof of a conventional automobile or passenger car, including small passenger cars, and a tent structure, housed in the housing and adapted to be erected, following removal of the unit from the car, by merely folding the tent structure, shown as roof and side panels outwardly, supporting the roof on the poles 117, and thereafter, folding out the right and front panels to form the floor and the front and the rear walls of the tent, which can then be joined to the side walls and the roof in a simple manner. The housing unit also contains the camping conveniences affording, work space, cooking and sink facilities, as well as storage facilities.

Figure 24:
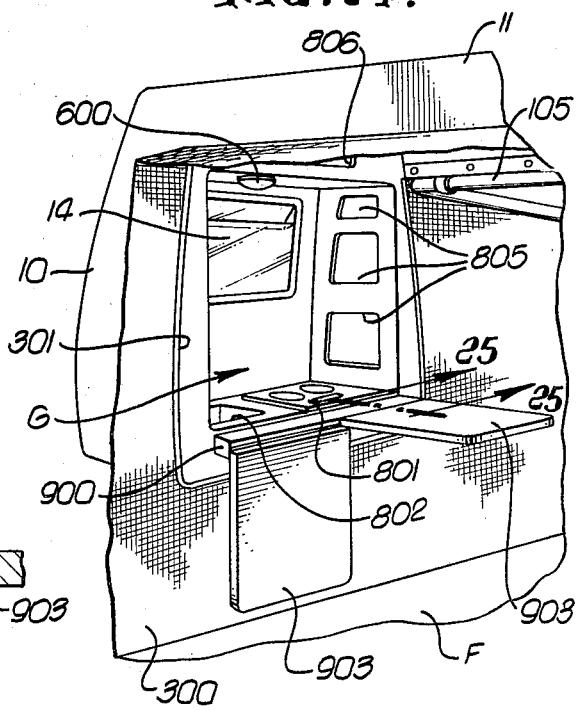
FIG. 24 is a view corresponding to FIG. 23, but illustrating work surface structures applied to the bumper engaging support structure of the camper unit.
Figure 25:
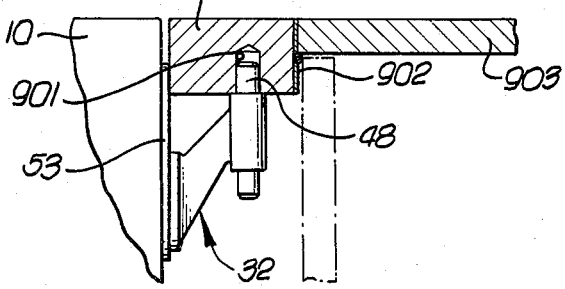
FIG. 25 is an enlarged fragmentary view in section, as taken on the line 25—25 of FIG. 24.
Figure 8:
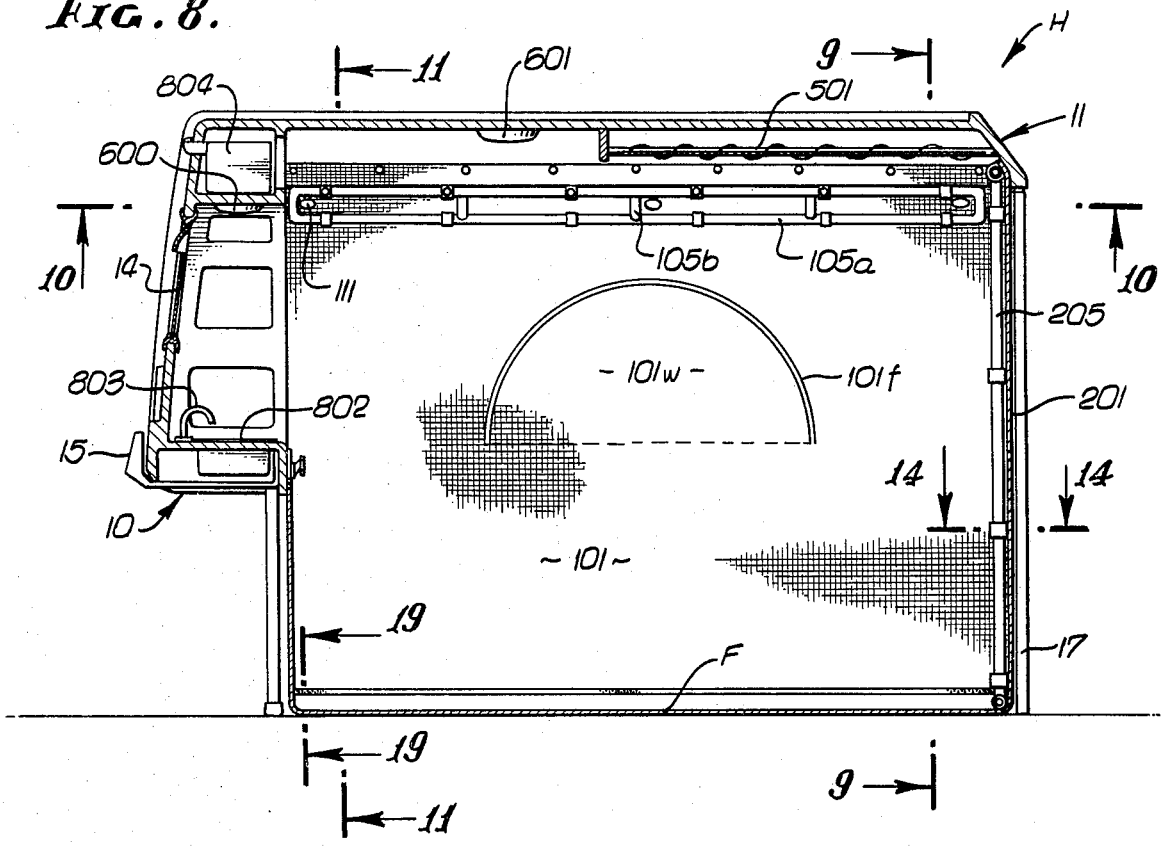
FIG. 8 is a vertical section, as taken on the line 8—8 of FIG. 7.

In order to enhance the work space, as seen in FIG. 24 and 25, a fold-down table structure is provided. This structure includes a horizontally extended support member 900 having laterally spaced sockets 901 adapted to receive the hitch pins 48, whereby the support member 900 is horizontally extended in closely adjacent relation to the work space 800. Mounted upon the outer vertical side of the support member 900, as by hinges 902 is one or a plurality of folding tables 903 which can be hingedly moved from an upper, horizontal condition, to a vertically disposed, out of the way position. When not in use the table structure can simply be removed from the hitch pins 48 and stored in a convenient location, such as for example in the sling in the ceiling of the housing structure.

We claim:

1. A camper tent unit comprising a housing structure having a vertical section and a horizontal hollow shell section; means for supporting said housing structure on a passenger vehicle with said vertical section supported on the rear and said horizontal section extending forwardly on top of the vehicle; said horizontal shell section having a roof and front and side walls extending downwardly from said roof to form a storage space;

flexible fabric tent components having means connecting the components to said front and side walls for folding storage in said shell and erectable to form with said housing structure, when removed from the vehicle, a laterally extended tent roof and side, front and rear tent walls connected with one another and with said housing structure to form an enclosure; and means providing frame structures connected with said roof and said front wall tent components to form rigid support therefore, when deployed from said housing structure.

2. A camper and tent unit as defined in claim 1; said means for supporting said housing structure including connector means supportable on the rear bumper of the vehicle and means mounting said horizontal section on the roof of the vehicle.

3. A camper and tent unit as defined in claim 2; means enabling adjustment of the height of said connector means.

4. A camper and tent unit as defined in claim 1; said means for supporting said housing structure including connector means supportable on the rear bumper of the vehicle and means mounting said horizontal section on the roof of the vehicle, and bumper means extending from said connector means to the rear of said vertical section.

5. A camper tent unit as defined in claim 1; said vertical unit including a galley having a horizontal shelf with a sink and laterally spaced side walls and a rear wall defining a forwardly opening access to said galley.

6. A camper tent unit as defined in claim 1; including said frame structure connected to said tent roof and received in said horizontal section upon folding said tent roof into said horizontal section.

7. A camper tent unit as defined in claim 1; said tent components including a floor interconnectable with said tent walls.

8. A camper tent unit as defined in claim 1; said tent components including a floor connected with a pair of opposed walls to be stored in said horizontal section with said opposed tent walls, and means for connecting said floor with the other opposed tent walls.

9. A camper tent unit as defined in claim 1; said tent roof and one of said front and rear tent walls being hingedly connected with one of said side walls of said horizontal section to swing into and from said horizontal section.

10. A camper tent unit as defined in claim 1; said tent roof and one of said front and rear tent walls being hingedly connected with one of said side walls of said horizontal section to swing into and from said horizontal section, said tent roof and said side walls of said horizontal section having interconnecting means for securing the roof as a protective closure for the bottom of said horizontal section.

11. A camper tent unit comprising a housing structure having a vertical section and a horizontal shell section; means for supporting said housing structure on a passenger vehicle with said vertical section supported on the rear and said horizontal section extending forwardly on top of the vehicle; said horizontal section including a top and side walls extending from said vertical section and a front wall; and flexible fabric tent means connected with certain of said housing walls and foldable into the underside of said shell and from said shell and erectable to form an enclosure including said top, side and front walls and said horizontal section, said enclosure having a laterally extending flexible fabric roof, side front and rear walls connected with one another and with said vertical section, and rigid frame structure connected with at least said roof and adapted to be engaged by ground support posts.

12. A camper and tent unit as defined in claim 11; means for retaining said tent means in said shell and forming a protective cover including a section of said tent means.

13. A camper and tent unit as defined in claim 11; said means for supporting said housing structure including connector means supportable on the rear bumper of the vehicle and means mounting said horizontal section on the roof of the vehicle.

14. A camper and tent unit as defined in claim 13; means for adjusting the height of said connector means.

15. A camper and tent unit as defined in claim 11; said means for supporting said housing structure including connector means supportable on the rear bumper of the vehicle and means mounting said horizontal section on the roof of the vehicle, and bumper means extending from said connector means to the rear of said vertical section.

16. In a camper tent unit as defined in claim 11, said vertical section having ground engaging posts for supporting said vertical section, said horizontal section having means engageable by forward posts at opposite sides allowing removal of the vehicle from beneath said housing.

17. A camper tent unit as defined in claim 11, said tent roof and side walls folding together at opposite sides of said shell section for storage therein; and including a floor between said tent front and rear walls; said tent front and rear walls and said tent front and rear walls and said floor folding together for storage in said shell section; said rear wall having an opening receiving said vertical section of said housing; and fastener means for releasable connecting said tent roof and said tent front and rear walls and connecting said tent rear wall to said vertical section at opposite sides thereof; and including corner posts at the intersections of said tent roof and said tent side, front and rear walls.

18. In a camper tent unit as defined in claim 11; said vertical section having ground engaging posts for supporting said vertical section, said horizontal section having means engageable by forward posts at opposite sides allowing removal of the vehicle from beneath said housing; said tent roof and side walls folding together at opposite sides of said shell section for storage therein; and including a floor between said tent front and rear walls; said tent front and rear walls and said floor folding together for storage in said shell section; said rear wall having an opening receiving said vertical section of said housing; and fastener means for releasably connecting said tent roof and said tent front and rear walls and said rear wall to said vertical section of said housing at opposite sides thereof; and including corner posts at the intersections of said tent roof and said tent side, front and rear walls.

19. A camper unit as defined in claim 11, said tent roof and side walls folding together at opposite sides of said shell section for storage therein; and including a floor between said tent front and rear walls; said tent front and rear walls and said floor folding together for storage in said shell section; said rear wall having an opening receiving said vertical section of said housing; and fastener means for releasably connecting said tent roof and said tent front and rear walls and connecting said rear wall to said vertical section of said housing at opposite sides thereof; and including corner posts at the intersections of said tent roof, side, front and rear walls; and frame structure beneath said tent roof and connected thereto for folding between said tent roof and side walls.

20. A camper unit as defined in claim 11, said tent roof and side walls folding together at opposite sides of said shell section for storage therein; and including a floor between said tent front and rear walls, said tent front and rear wall and said floor folding together for storage in said shell section; said rear wall having an opening receiving said vertical section of said housing, and fastener means for releasably connecting said tent roof and said tent front and rear walls and connecting said rear wall to said vertical section of said housing at opposite sides thereof; and including corner posts at the intersections of said tent roof, side, front and rear walls; frame structures beneath said tent roof and connected thereto for folding between said tent roof and side walls; said corner posts engaging said frame structures.

21. A camper unit as defined in claim 11; including means for supporting said vertical section at different heights on said rear bumper.

* * * * *